US011090715B2

(12) United States Patent
Dong et al.

(10) Patent No.: US 11,090,715 B2
(45) Date of Patent: Aug. 17, 2021

(54) METHOD FOR DESIGNING REFINER PLATES WITH EQUIDISTANT CURVED BARS

(71) Applicant: Shaanxi University of Science & Technology, Shaanxi (CN)

(72) Inventors: Jixian Dong, Shaanxi (CN); Huan Liu, Shaanxi (CN); Xiya Guo, Shaanxi (CN); Bo Wang, Shaanxi (CN); Dong Wang, Shaanxi (CN); Hui Jing, Shaanxi (CN); Sha Wang, Shaanxi (CN); Ruifan Yang, Shaanxi (CN)

(73) Assignee: Shaanxi University of Science & Technology, Xi'an (CN)

( * ) Notice: Subject to any disclaimer, the term of this patent is extended or adjusted under 35 U.S.C. 154(b) by 97 days.

(21) Appl. No.: 16/578,281

(22) Filed: Sep. 21, 2019

(65) Prior Publication Data

US 2020/0130055 A1 Apr. 30, 2020

(30) Foreign Application Priority Data

Oct. 30, 2018 (CN) ..... 201811280606.X

(51) Int. Cl.

| | |
|---|---|
| ***B22D 46/00*** | (2006.01) |
| ***B22D 25/02*** | (2006.01) |
| ***B02C 7/12*** | (2006.01) |
| ***D21D 1/30*** | (2006.01) |

(52) U.S. Cl.

CPC ..... *B22D 46/00* (2013.01); *B02C 7/12* (2013.01); *B22D 25/02* (2013.01); *D21D 1/306* (2013.01)

(58) Field of Classification Search

CPC B02C 18/182; B02C 7/12; B02C 7/13; B29B 2017/0484; D21D 1/30; D21D 1/303; D21D 1/306

See application file for complete search history.

(56) References Cited

U.S. PATENT DOCUMENTS

| | | | | |
|---|---|---|---|---|
| 27,551 A * | 3/1860 | Littlepage | ..... | B02C 7/12 241/296 |
| 1,169,228 A * | 1/1916 | Barker | ..... | B02C 7/12 241/296 |
| 1,609,717 A | 12/1926 | Holland-Letz | | |

(Continued)

FOREIGN PATENT DOCUMENTS

| | | |
|---|---|---|
| CN | 202428341 U | 9/2012 |
| CN | 205556469 U | 9/2016 |

*Primary Examiner* — Jacob J Cigna

(57) ABSTRACT

The present invention discloses a method for designing a refiner plate with equidistant curved bars, comprising following steps of: designing a central bar are of center curved bar and defining the bar angle for the equidistant curved bar; designing circle arcs for curved bars on two sides of center curved bar of equidistant curved bar segment; when the whole refining segment is full of circle arcs, trimming lines of outer circle arcs of the refining segment to complete the design of equidistant circle arcs on the two sides; and if required, dividing the bars into zones. In the present invention, by the definition of the bar angle for the curved bars and the parametric design of the equidistant curved bars by using circle are equations, it is ensured that the flexibility in designing an equidistant curved bar refiner plate is improved.

3 Claims, 5 Drawing Sheets

(56) References Cited

U.S. PATENT DOCUMENTS

| | | | | |
|---|---|---|---|---|
| 1,612,437 | A * | 12/1926 | Holland-Letz | B02C 7/13 241/296 |
| 1,705,379 | A | 3/1929 | Sheppard, Jr. | |
| 3,674,217 | A | 7/1972 | Reinhall | |
| 4,023,737 | A * | 5/1977 | Leider | B02C 7/12 241/261.3 |
| 5,425,508 | A * | 6/1995 | Chaney | B02C 7/12 241/261.2 |
| 7,398,938 | B2 | 7/2008 | Antensteiner | |
| 9,988,762 | B2 * | 6/2018 | Bilodeau | D21D 1/30 |
| 2006/0113415 | A1 * | 6/2006 | Antensteiner | D21D 1/24 241/298 |
| 2008/0210795 | A1 * | 9/2008 | Antensteiner | D21D 1/306 241/261.3 |
| 2009/0001204 | A1 | 1/2009 | Antensteiner | |
| 2012/0032010 | A1 * | 2/2012 | Ghibellini | D21D 1/306 241/244 |
| 2012/0294725 | A1 | 11/2012 | Hackl et al. | |
| 2017/0073893 | A1 * | 3/2017 | Bilodeau | D21D 1/306 |

* cited by examiner

METHOD FOR DESIGNING REFINER PLATES WITH EQUIDISTANT CURVED BARS

CROSS-REFERENCE TO RELATED APPLICATIONS

This application claims the benefit of priority from Chinese Patent Application No. CN 201811280606.X, filed on Oct. 30, 2018. The content of the aforementioned application, including any intervening amendments thereto, is incorporated herein by reference in its entirety.

TECHNICAL FIELD

The present invention belongs to the technical field of designing the bar shape of a refiner plate for a plate refiner, and particularly relates to a method for designing a refiner plate with equidistant curved bars.

BACKGROUND OF THE PRESENT INVENTION

The refiner plate, as a direct-acting component of a plate refiner, is used for related material crushing and performance improvement processes, such as refining pulp, nitrocellulose and fine particles. At present, refining segments with straight bars and refining segments with curved bars are commonly known. Refining segments with curved bars are highly favored due to their small attack angle change in the angle during the interaction of bars on the stator and rotor. However, it is complex in the design of their curves.

Curved bars have been introduced in related foreign patents. For example, a refining segment, having both curved bars that are in radial shape and straight bars, was introduced in U.S. Pat. No. 19,273; radial curved bars that are arranged in a dislocation mode were introduced in U.S. Pat. No. 27,551; small-angle curved bars that are distributed in clusters were introduced in U.S. Pat. No. 71,733; different types of refiner plates with curved bars were respectively proposed in U.S. Pat. Nos. 120,505, 348,637, 1,609,717 and 1,705,379, but no method for designing the bar shape was introduced in those patents; a refiner plate with multi-stage curved bars that are arranged in a dislocation mode was introduced in U.S. Pat. No. 499,714, wherein there are total four stages of bars, the starting point of the $1_{st}$ stage bars is stepped, and the width of the designed bars gradually decreases from inside to outside, but the design method and the definition of curved bars had not yet been explained; a specific curved bar was discussed in U.S. Pat. No. 1,609,717, wherein the feed of material is done by the edge of the bar; a refiner plate with curved bars, which has a retaining wall, the radian of which gradually increases in the radius direction and which is used for refining, was introduced in U.S. Pat. No. 3,674,217; two logarithmic spiral curved bars were introduced in U.S. Pat. No. 7,398,938B and US2009/0001204A1; a refining segment with both straight bars and curved bars, which is used for refining of wood pulp for papermaking, was proposed in U.S. Pat. No. 4,023,737, wherein a curved zone consists of continuous circular curves and has a constant channel cross-sectional area and circle centers of the curved bars are concentrated at the center of the construction circle, but this design fails to ensure that both the width of the bars and the width of the channels will not change in the radial direction; and a dislocated curved plate for the treatment of polymers was proposed in US2012/0294725A1, wherein the curved bars are not rectangular, and the degree of inclination of the curved bars are represented by an included angle between the tangent line of the starting circle are and the radius direction and an included angle between the tangent line of the ending circle are and the radius direction. Curved bars also have been introduced in Chinese patents. For example, a cement refining segment, on which first and second radial curved bars are arranged, was proposed in CN205556469; and a diamond refining plate with curved bars was proposed in CN202428341U. None of those patents involves curved bars that are spaced apart at an equal distance or proposes ideas about how to represent the angle of inclination of the curved bars. There is little or no description of the design of the curved bars.

How to design curved bars was less studied both in China and abroad. Compared with straight bars, the definition of the angle of inclination of curved bars is complex. If the angle of inclination of curved bars can be defined correctly and the correct equation of the circle arcs can be found, the efficiency of designing curved bars can be improved greatly.

SUMMARY OF THE PRESENT INVENTION

An objective of the present invention is to provide a method for designing a refiner plate with equidistant curved bars. By appropriately defining the bar angle and the starting bar angle of the curved bars and using correct polar coordinates, curve equations are established for the center lines for equidistant bars and for the edges of the curved bars, and the flexibility in designing equidistant curved bars is improved.

The present invention is implemented by the following technical solutions.

A method for designing a refiner plate with equidistant curved bars is provided, comprising following steps:

1) designing a center circle arc for the equidistant curved bars:

defining, on the basis of defining a bar angle of the curved bars, a center circle are for the curved bars, and establishing an equation for the circle are for the curved bars by establishing a polar coordinate system;

2) designing circle arcs for curved bars on two sides of a center curved bar of equidistant curved refining segment:

establishing, in consideration of the bar width and the groove width of segment, an equation of circle arcs for bars on two sides of a center curved bar;

3) when the whole refining segment is fill of circle arcs of curved bars, trimming lines of outer circle arcs of the refining segment to complete the design of equidistant circle arcs on the two sides, wherein, according to refining process requirements, the refiner plate with equidistant curved bars are divided into zones along a predetermined standard line and then trimmed, the bar height is determined according to the refining process requirements, so far the design of a refining segment with equidistant curved bars is completed, and a refiner plate with equidistant curved bars is obtained; and 4) machining such a refiner plate in accordance with methods for common refiner plates, including: casting which is applicable for industrial mass-production of refiner plates and milling which is applicable for experimental refiner plates, with casting including following operations as main steps: design and development of a refining segment mold, manufacture of a cavity suitable for casting, alloy smelting and casting, opening the mold for the purpose of cleaning (sand cleaning, de-gating), initial machining, thermal treatment, finish machining, and inspection.

Further, the step 1) specifically comprises following steps:

step 1: defining a bar angle of the curved bars:

given that the refining segment has an inner diameter $R_i$, an outer diameter $R_o$ and a circle center O, the refining segment has a center circle are MN, the center circle are MN in the refining segment has a radius $(R_i+R_o)/2$, OB is a bisector of the refining segment, and the center circle are in the refining segment intersects with OB at a point B, making BD passing through the point B at the top right of OB if the curved bars are right-hand bars and making BD passing through the point B at the top left of OB if the curved bars are left-hand bars;

representing an included angle between BD and OB by α, selecting any point A from an inner circle in the refining segment as a starting point of the curve bars, connecting the points O and A, making a circle $O_1$ passing through the points A and B by using BD as a tangent line, making a tangent line AE, passing through the point A, which is tangent to the circle $O_1$ with an included angle between AE and OA represented by β, with a line perpendicular to the tangent line AE and a line perpendicular to BD intersecting at a point $O_1$ and the radius of the circle $O_1$ being measured as $R_i$; and obtaining an intersected portion of the circle $O_1$ with inner and outer circles in the refining segment as a center line for curved bars, and assuming that an included angle α between the tangent line BD that is tangent to the center line for curved bars at the point B and OB starting from the point B in the radius direction is bar angle of the equidistant curved bars and an included angle β between the tangent line AE that is tangent to the circle $O_1$ at the point A and OA is a starting bar angle of the equidistant curved bars, A being the starting point of the circle arcs;

step 2: designing an equation for the center circle are for the equidistant curved bars:

designing a center circle are AC for the equidistant curved bars by determining the points A and B and defining a bar angle α of the bars, wherein A is the starting point of the center are for the bars, which can be expressed by $(\gamma, r_A)$, where γ is an included angle between the OA and the center line of the refining segment, $r_A$ is the radius of the circle where the starting point is located, and then the center are AC for the equidistant curved bars can be determined by the point A and the bar angle α; and obtaining an equation for the circle $O_1$ according to the polar coordinate system by: using the point $O_1$ as a pole and drawing a horizontal ray O-x from the pole as a polar axis, using the clockwise direction as the positive direction, and representing an included angle between a connecting line from any one point on the circle Or to the pole, and the polar axis as θ:

$$\begin{cases} x = R_1\cos\theta \\ y = R_1\sin\theta \end{cases} \tag{1}$$

wherein the equation (1) is the equation for the circle of the center circle arc AC for the equidistant curved bars;

step 3: designing equations for circle arcs at the edges of the center bars:

given that the width of the curved bars is b, respectively representing equations for inner and outer circle arcs for the center bars as:

$$\begin{cases} x = \left(R_1 + \frac{b}{2}\right)\cos\theta \\ y = \left(R_1 + \frac{b}{2}\right)\sin\theta \end{cases} \text{ and } \begin{cases} x = \left(R_1 - \frac{b}{2}\right)\cos\theta \\ y = \left(R_1 - \frac{b}{2}\right)\sin\theta \end{cases} \tag{2}$$

Further, the step 2) specifically comprises following steps:

step 1: given that the groove width for the curved bars is g, designing circle arcs for curved bars on one side of the curved refining segment:

when the refining segment with equidistant curved bars are designed with right-hand curved bars, representing an equation for a circle are for the first bar on the left side of the circle arc for the center bar as:

$$\begin{cases} x = \left(R_1 + \frac{b}{2} + g\right)\cos\theta \\ y = \left(R_1 + \frac{b}{2} + g\right)\sin\theta \end{cases} \tag{3}$$

representing an equation for a circle are for a $2n^{th}$ bar on the left side as:

$$\begin{cases} x = \left(R_1 + \frac{b}{2} + n(g+b)\right)\cos\theta \\ y = \left(R_1 + \frac{b}{2} + n(g+b)\right)\sin\theta \end{cases} \tag{4}$$

representing an equation for a circle are for a $(2n+1)^{th}$ bar on the left side as:

$$\begin{cases} x = \left(R_1 + \frac{b}{2} + g + n(g+b)\right)\cos\theta \\ y = \left(R_1 + \frac{b}{2} + g + n(g+b)\right)\sin\theta \end{cases} \tag{5}$$

where, $n \geq 1$;

when the refining segment with equidistant curved bars are designed with left-hand curved bars, equations for circle arcs for bars on the right side of the circle are for the center bar are the same as equations for circle arcs for bars on the left side of the circle arc for the center bar in the case where the refining segment is designed with right-hand curved bars;

step 2: designing circle arcs for curved bars on the other side of the curved bar refining segment:

when the refining segment with equidistant curved bars are designed with right-hand curved bars, representing an equation for a circle arc for the first bar on the right side of the circle are for the center bar as:

$$\begin{cases} x = \left(R_1 - \frac{b}{2} - g\right)\cos\theta \\ y = \left(R_1 - \frac{b}{2} - g\right)\sin\theta \end{cases} \tag{6}$$

representing an equation for a circle arc for a $2n^{th}$ bar on the right side as:

$$\begin{cases} x = \left(R_1 - \frac{b}{2} - n(g+b)\right)\cos\theta \\ y = \left(R_1 - \frac{b}{2} - n(g+b)\right)\sin\theta \end{cases} \quad (7)$$

representing an equation for a circle are for a $(2n+1)^{th}$ bar on the right side as:

$$\begin{cases} x = \left(R_1 - \frac{b}{2} - g - n(g+b)\right)\cos\theta \\ y = \left(R_1 - \frac{b}{2} - g - n(g+b)\right)\sin\theta \end{cases} \quad (8)$$

where, $n \geq 1$ and n is a positive integer;

when the refining segment with equidistant curved bars are designed with left-hand curved bars, equations for circle arcs for bars on the left side of the circle are for the center bar are the same as equations for circle arcs for bars on the right side of the circle arc for the center bar in the case where the refining segment is designed with right-hand curved bars.

Further, the step 3) specifically comprises following steps:

after the design of the refiner plate with equidistant curved bars and the design of the circle arcs are completed, if required, dividing the refiner plate into zones by concentric circle arcs, circle arcs or broken lines or the like;

Taking the division by concentric circle arcs as example, the refiner plate is divided into three stages: a breaking zone, a coarse refining zone and a fine refining zone, at a ratio of $k_1:k_2:k_3$, and equations for circle arcs in the breaking zone and the coarse refining zone are represented as:

$$\begin{cases} x = \left[\frac{k_1(R_0 - R_i)}{k_1 + k_2 + k_3} + R_i\right]\cos\theta \\ y = \left[\frac{k_1(R_0 - R_i)}{k_1 + k_2 + k_3} + R_i\right]\sin\theta \end{cases} \quad (9)$$

equations for circle arcs in the coarse refining zone and the fine refining zone are represented as:

$$\begin{cases} x = \left[\frac{(k_1 + k_2)(R_0 - R_i)}{k_1 + k_2 + k_3} + R_i\right]\cos\theta \\ y = \left[\frac{(k_1 + k_2)(R_0 - R_i)}{k_1 + k_2 + k_3} + R_i\right]\sin\theta \end{cases} \quad (10)$$

the methods for determining equations for concentric circle arcs in other zones are similar to equations (9) and (10);

after the division, according to process requirements, the bars are optimized, and usually, the number of bars in the breaking zone, the coarse refining zone and the fine refining zone are successively increased.

5. The method for designing a refiner plate with equidistant curved bars according to claim 1, wherein the step 4) specifically comprises following steps:

casting which is applicable for industrial mass-production of refiner plates and milling which is applicable for experimental refiner plates, with casting including following operations as main steps: design and development of a refining segment mold, manufacture of a cavity suitable for casting, alloy smelting and casting, opening the mold for the purpose of cleaning (sand cleaning, de-gating), initial machining, thermal treatment, finish machining, and inspection.

Compared with the prior art, the present invention has the following beneficial effects:

By the method for designing a refiner plate with equidistant curved bars disclosed in the present invention, the problem that it is unable to measure the angle of inclination of curved bars on a plate refiner is solved. By defining the bar angle and the starting bar angle of the center circle arcs for the bars, the bar angle and the position of the equidistant curved bars in the refining segments are determined. Equations are established for the circles where the center circle arcs for bars and for the circle arcs at the edges of the center bars are located. In consideration of the bar width and the groove width, an equation is derived for the circles where circle arcs for bars on two sides of a center curved bar. By the establishment of equations, the determination of the circle arcs for the bars is more flexible and the design process is simplified.

Further, the present invention discloses specific equations for designing center circle arcs of the equidistant curved bars, circle arcs at the edges of the center bar, and the circle where circle arcs for bars on the two sides of the center bar are located. Various parameters of a refining segment to be designed may be substituted into the equations. In this way, a desired refiner plate can be designed quickly. Compared with a refiner plate with straight bars, with same parameters, the present invention has a lower refining intensity and can effectively maintain the fiber length while also improving the beating degree.

DETAILED DESCRIPTION OF THE PRESENT INVENTION

The present invention will be further described below by specific embodiments. The description is merely provided for explaining the present invention, rather than limiting the present invention.

A method for designing a refiner plate with equidistant curved bars is provided, comprising following steps:

1) designing a center circle are for the equidistant curved bars:

defining, on the basis of defining a bar angle of the curved bars, a center circle are for the curved bars, and establishing an equation for the circle arc for the curved bars by establishing a polar coordinate system;

2) designing circle arcs for curved bars on two sides of a center bar of equidistant curved refining segment:

establishing, in consideration of the bar width and groove width, an equation of circle arcs for bars on two sides of a center curved bar;

3) when the whole refining segment is full of circle arcs of curved bars, trimming lines of outer circle arcs of the refining segment to complete the design of equidistant circle arcs on the two sides, wherein, according to refining process requirements, the refiner plate with equidistant curved bars are divided into zones along a predetermined standard line and then trimmed, so far the design of a refining segment with equidistant curved bars is completed, and a refiner plate with equidistant curved bars is obtained.

Figure 1:
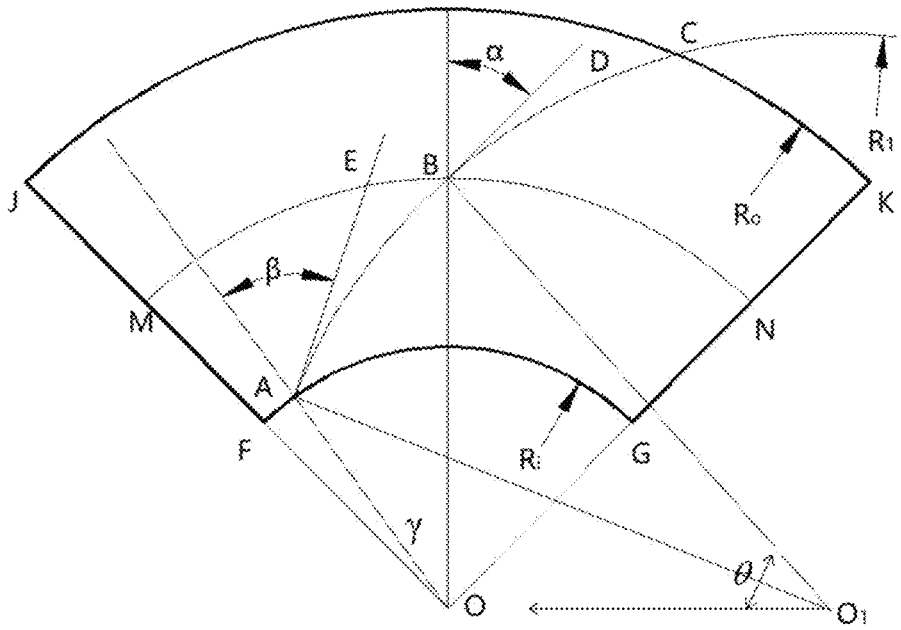
FIG. 1 is a schematic view of defining a center circle are of the bar angle of the equidistant curved bars according to the present invention.
Figure 2:
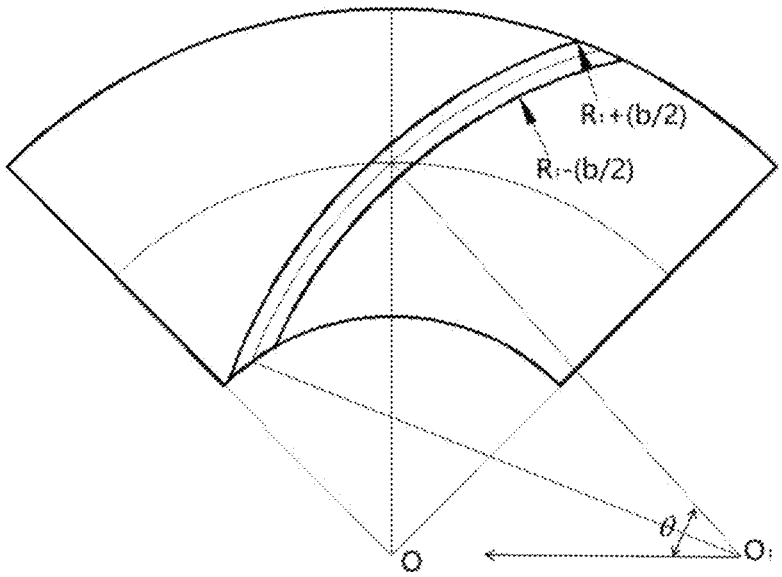
FIG. 2 is a schematic view of establishing a curve at the edge of the center curved bar of the equidistant curved bars according to the present invention.

1. The design of a center circle are for the equidistant curved bars specifically comprises following steps:

step 1: designing a circle are for the bar angle of the equidistant curved bars:

as shown in FIG. 1, given that the refining segment has an inner diameter $R_i$, an outer diameter $R_o$ and a circle center O, the refining segment has a center circle are MN, the center circle arc MN in the refining segment has a radius $(R_i+R_o)/2$, OB is a bisector of the refining segment, and the center circle are in the refining segment intersects with OB at a point B, making BD passing through the point B at the top right of OB if the curved bars are right-hand bars and making BD passing through the point B at the top left of OB if the curved bars are left-hand bars, representing an included angle between BD and OB by a, selecting any point A from an inner circle in the refining segment as a starting point of the curve bars, and connecting the points O and A;

making a circle $O_1$ passing through the points A and B by using BD as a tangent line, making a tangent line AE, passing through the point A, which is tangent to the circle $O_1$ with an included angle between AE and OA represented by β, with a line perpendicular to the tangent line AE and a line perpendicular to BD intersecting at a point $O_1$ and the radius of the circle $O_1$ being measured as $R_i$; and obtaining an intersected portion of the circle $O_1$ with inner and outer circles in the refining segment as a center line for curved bars, and assuming that an included angle α between the tangent line BD that is tangent to the center line for curved bars at the point B and OB starting from the point B in the radius direction is the bar angle of the equidistant curved bars and an included angle β between the tangent line AE that is tangent to the circle $O_1$ at the point A and OA is a starting bar angle of the equidistant curved bars;

step 2: designing an equation for the center circle are for the equidistant curved bars:

designing a center circle are AC for the equidistant curved bars by determining the points A and B and defining a bar angle α of the bars, wherein A is the starting point of the center are for the bars, which can be expressed by $(\gamma, r_A)$, where γ is an included angle between the OA and the center line of the refining segment, $r_A$ is the radius of the circle where the starting point is located, and then the center are AC for the equidistant curved bars can be determined by the point A and the bar angle α; and obtaining an equation for the circle $O_1$ according to the polar coordinate system by: using the point $O_1$ as a pole and drawing a horizontal ray O-x from the pole as a polar axis, using the clockwise direction as the positive direction, and representing an included angle between a connecting line from any one point on the circle $O_1$ to the pole, and the polar axis as θ:

$$\begin{cases} x = R_1\cos\theta \\ y = R_1\sin\theta \end{cases} \tag{1}$$

wherein the equation (1) is the equation for the circle of the center circle are AC for the equidistant curved bars;

step 3: designing equations for circle arcs at the edges of the center bars:

as shown in FIG. 2, given that the width of the equidistant curved bars is b, respectively representing equations for inner and outer circle arcs for the center bars as:

$$\begin{cases} x = \left(R_1 + \frac{b}{2}\right)\cos\theta \\ y = \left(R_1 + \frac{b}{2}\right)\sin\theta \end{cases} \text{ and } \begin{cases} x = \left(R_1 - \frac{b}{2}\right)\cos\theta \\ y = \left(R_1 - \frac{b}{2}\right)\sin\theta \end{cases} \tag{2}$$

2. The design of circle arcs for curved bars on two sides of the equidistant curved refining segment specifically comprises following steps:

step 1: designing curved bars on the left side of the equidistant curved refining segment:

given that the groove width for the curved bar plate is g, representing an equation for a circle are for the first bar on the left side as:

$$\begin{cases} x = \left(R_1 + \frac{b}{2} + g\right)\cos\theta \\ y = \left(R_1 + \frac{b}{2} + g\right)\sin\theta \end{cases} \tag{3}$$

representing an equation for a circle are for a $2n^{th}$ (n≥1) bar on the left side as:

$$\begin{cases} x = \left(R_1 + \frac{b}{2} + n(g+b)\right)\cos\theta \\ y = \left(R_1 + \frac{b}{2} + n(g+b)\right)\sin\theta \end{cases} \tag{4}$$

representing an equation for a circle arc for a $(2n+1)^{th}$ (n≥1) bar on the left side as:

$$\begin{cases} x = \left(R_1 + \frac{b}{2} + g + n(g+b)\right)\cos\theta \\ y = \left(R_1 + \frac{b}{2} + g + n(g+b)\right)\sin\theta \end{cases} \tag{5}$$

By the arrangement of circle arcs, when the whole refining segment is full of circle arcs of bars, lines of outer circle arcs of the refining segment are trimmed to complete the design of equidistant circle arcs on the left side.

Figure 4:
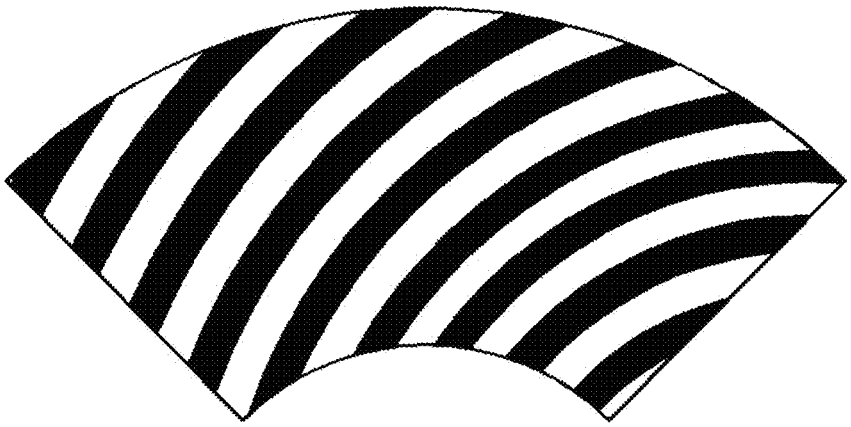
FIG. 4 is a schematic view of a refining segment with equidistant curved bars according to the present invention.

Similarly, when the curved bars are left-hand bars, equations for circle arcs for bars on the right side are the same as equations in the step 1;

step 2: designing curved bars on the right side of the equidistant curved refining segment:

given that the groove width for the curved bar plate is g, representing an equation for a circle are for the first bar on the right side as:

$$\begin{cases} x = \left(R_1 - \frac{b}{2} - g\right)\cos\theta \\ y = \left(R_1 - \frac{b}{2} - g\right)\sin\theta \end{cases} \tag{6}$$

representing an equation for a circle are for a $2n^{th}$ ($n \geq 1$) bar on the right side as:

$$\begin{cases} x = \left(R_1 - \frac{b}{2} - n(g+b)\right)\cos\theta \\ y = \left(R_1 - \frac{b}{2} - n(g+b)\right)\sin\theta \end{cases} \tag{7}$$

representing an equation for a circle arc for a $(2n+1)^{th}$ ($n \geq 1$) bar on the right side as:

$$\begin{cases} x = \left(R_1 - \frac{b}{2} - g - n(g+b)\right)\cos\theta \\ y = \left(R_1 - \frac{b}{2} - g - n(g+b)\right)\sin\theta \end{cases} \tag{8}$$

by the arrangement of circle arcs, when the whole refining segment is full of circle arcs, lines of outer circle arcs of the refining segment are trimmed to complete the design of equidistant circle arcs on the right side; so far, the design of the refining segment with equidistant curved bars is completed and a refiner plate as shown in FIG. 4 is obtained.

Similarly, when the curved bars are right-hand bars, equations for circle arcs for bars on the left side are the same as equations in the step 2.

3. The division of the refiner plate with equidistant curved bars specifically comprises following steps:

after the design of the refiner plate with equidistant curved bars and the design of the circle arcs are completed, if required, dividing the refiner plate into zones by concentric circle arcs, circle arcs or broken lines or the like.

Taking the division by concentric circle arcs as example, the refiner plate is divided into three stages: a breaking zone, a coarse refining zone and a fine refining zone, at a ratio of $k_1:k_2:k_3$, and equations for circle arcs in the breaking zone and the coarse refining zone are represented as:

$$\begin{cases} x = \left[\frac{k_1(R_0 - R_i)}{k_1 + k_2 + k_3} + R_i\right]\cos\theta \\ y = \left[\frac{k_1(R_0 - R_i)}{k_1 + k_2 + k_3} + R_i\right]\sin\theta \end{cases} \tag{9}$$

equations for circle arcs in the coarse refining zone and the fine refining zone are represented as:

$$\begin{cases} x = \left[\frac{(k_1 + k_2)(R_0 - R_i)}{k_1 + k_2 + k_3} + R_i\right]\cos\theta \\ y = \left[\frac{(k_1 + k_2)(R_0 - R_i)}{k_1 + k_2 + k_3} + R_i\right]\sin\theta \end{cases} \tag{10}$$

the methods for determining equations for concentric circle arcs in other zones are similar to equations (9) and (10).

Figure 5:
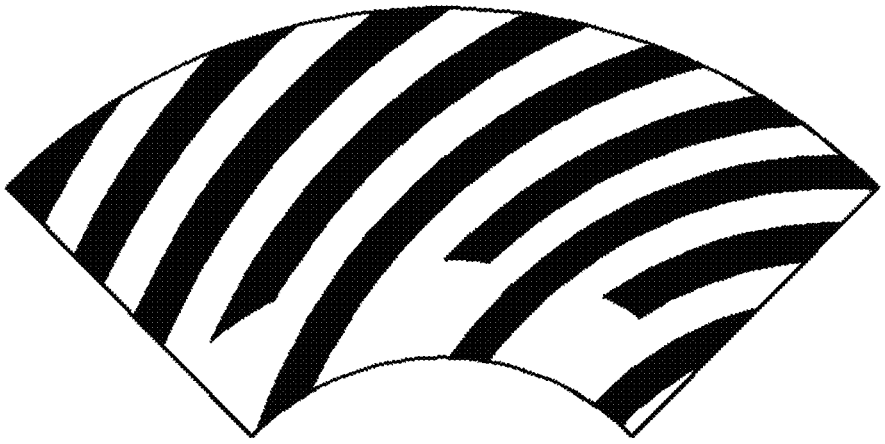
FIG. 5 is a schematic view of a refining segment with equidistant curved bars, which is divided into two stages, according to the present invention.

The refiner plate, which is divided into two stages and then trimmed, is as shown in FIG. 5.

The specific embodiment will be described below.

Papermaking plate refiners are important devices used in the pulping process. Now, it is required to design an experimental refining segment, which has an inner diameter of 82.5 mm and an outer diameter of 203 mm. The bar angle of the curved bars is 420, the starting angle of inclination is 34°, and the center angle of the refining segment is 40°. The bar width is 2 mm, the groove width is 3 mm, and the bar height is 4 mm.

A pattern is established, as shown in FIG. 1. A point A (20°, 43 mm) is selected from the inner diameter of the refining segment as the starting point of the bars, with the center angle of the refining segment of 40°, $R_i$=41.25 mm, R=101.5 mm. The center circle are in the refining zone has a radius of 71.375 mm, α=22°, β=34°. A circle $O_1$ passing through the points A and B is made by using BD and AE as tangent lines.

Then, $R_1$=71.375 mm, an equation for the center circle are for the equidistant curved bars is represented as:

$$\begin{cases} x = 71.375 \times \cos\theta \\ y = 71.375 \times \sin\theta \end{cases} \tag{11}$$

Figure 3:
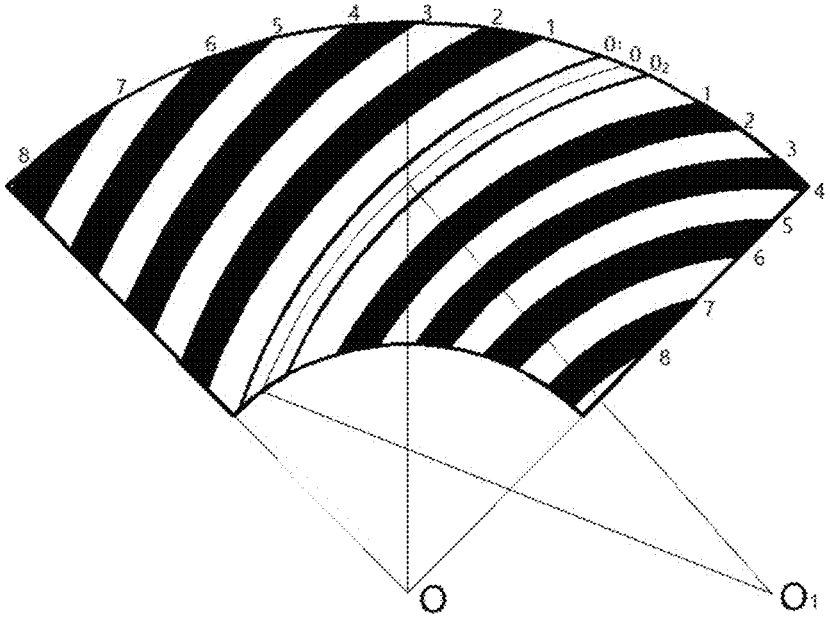
FIG. 3 is a schematic view of establishing curves for curved bars on two sides of the center curved bar according to the present invention.

As shown in FIG. 3, from the bar width and the groove width, equations for circle arcs $O_1$ and $O_2$ are represented as:

$$\begin{cases} x = 72.375 \times \cos\theta \\ y = 72.375 \times \sin\theta \end{cases} \text{ and } \begin{cases} x = 70.375 \times \cos\theta \\ y = 70.375 \times \sin\theta \end{cases} \tag{12}$$

then: an equation for a circle are for the first bar on the left side is represented as:

$$\begin{cases} x = 75.375 \times \cos\theta \\ y = 75.375 \times \sin\theta \end{cases} \tag{13}$$

an equation for a circle are for a $2n^{th}$ ($n \geq 1$) bar, for example, the second, fourth, sixth or eighth bar, on the left side is represented as:

$$\begin{cases} x = (72.375 + 7n) \times \cos\theta \\ y = (72.375 + 7n) \times \sin\theta \end{cases} \tag{14}$$

an equation for a circle are for a $(2n+1)^{th}$ ($n \geq 1$) bar, for example, the third, fifth, seventh or ninth bar, on the left side is represented as:

$$\begin{cases} x = (75.375 + 7n) \times \cos\theta \\ y = (75.375 + 7n) \times \sin\theta \end{cases} \quad (15)$$

As shown in FIG. 3, an equation for a circle are for the first bar on the right side of the center circle arc for the equidistant curved bars is represented as:

$$\begin{cases} x = 67.375 \times \cos\theta \\ y = 67.375 \times \sin\theta \end{cases} \quad (16)$$

an equation for a circle are for a $2n^{th}$ ($n \geq 1$) bar, for example, the second, fourth, sixth or eighth bar, on the right side is represented as:

$$\begin{cases} x = (67.375 - 7n) \times \cos\theta \\ y = (67.375 - 7n) \times \sin\theta \end{cases} \quad (17)$$

an equation for a circle are for a $(2n+1) \pm (n \geq 1)$ bar, for example, the third, fifth, seventh or ninth bar, on the left side is represented as:

$$\begin{cases} x = (64.375 - 7n) \times \cos\theta \\ y = (64.375 - 7n) \times \sin\theta \end{cases} \quad (18)$$

Figure 6:
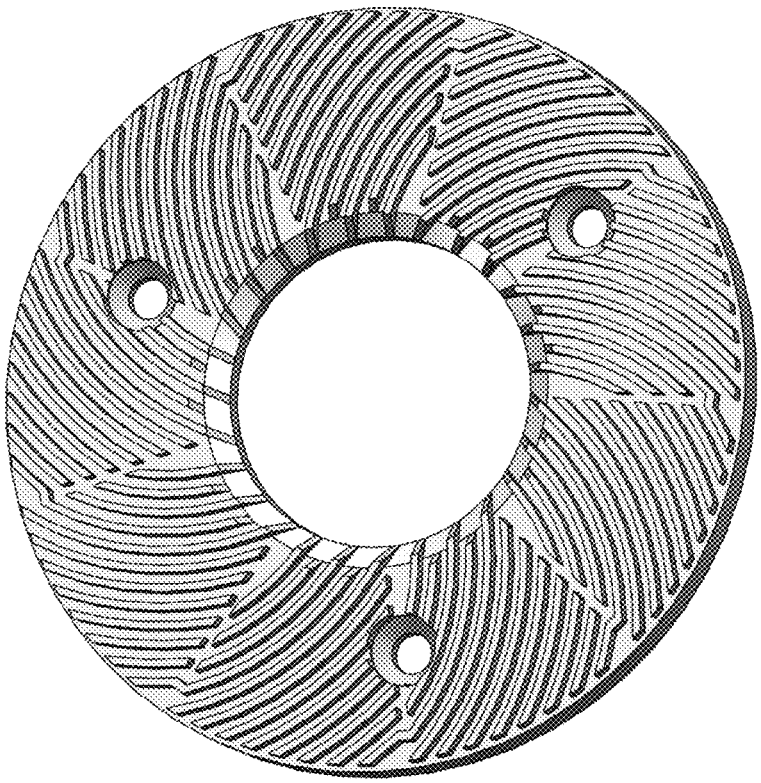
FIG. 6 is a schematic view of a refining segment with equidistant curved bars according to an embodiment of the present invention.

A refiner plate, as shown in FIG. 6, may be finally designed in a pattern, according to the equations (11)-(18) for circle arcs and the height of the bars of 4 mm.

Figure 7:
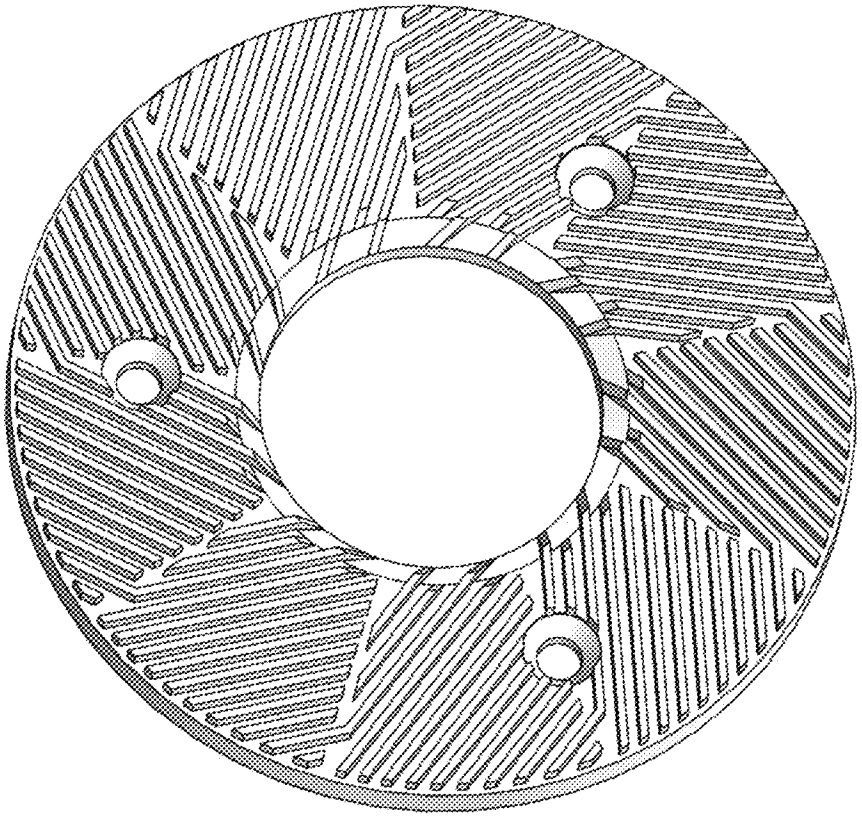
FIG. 7 is a refiner plate with straight bars, having the same parameters as the refiner plate according to an embodiment of the present invention.
Figure 8:
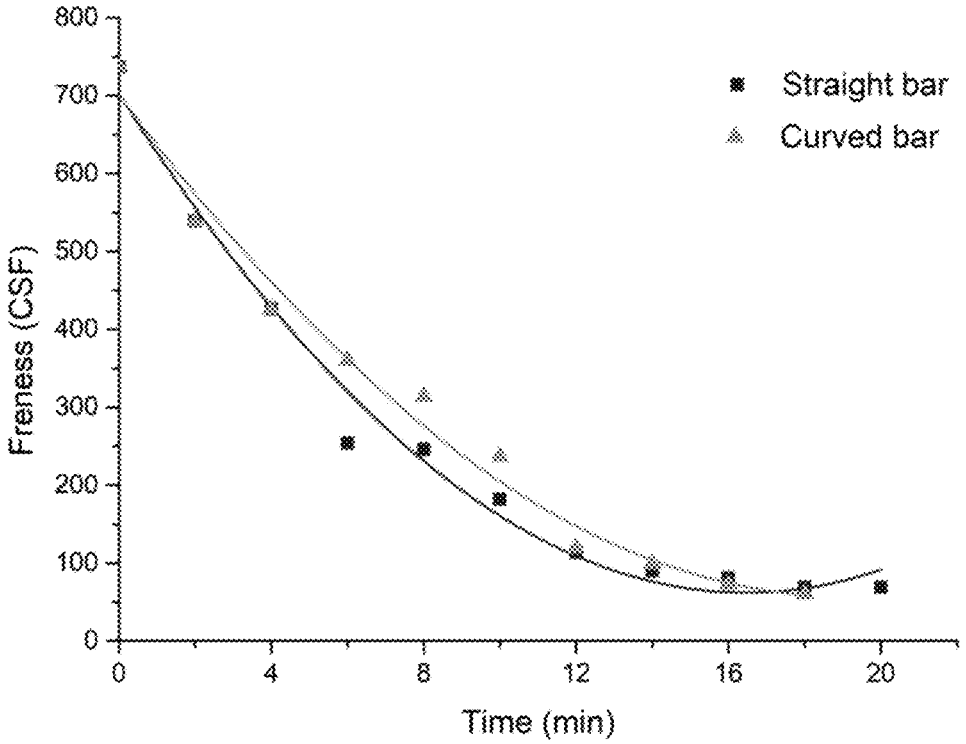
FIG. 8 shows the influence on the freeness of pulp by the refining segment with equidistant curved bars according to an embodiment of the present invention and a refiner plate with straight bars, with same parameters.
Figure 9:
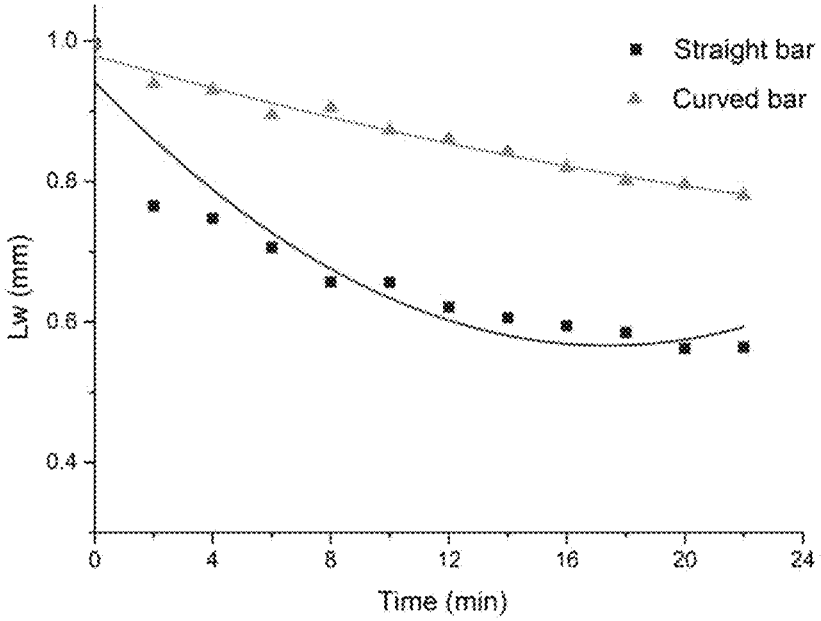
FIG. 9 shows the influence on the average length of fibers by the refining segment with equidistant curved bars according to an embodiment of the present invention and a refiner plate with straight bars, with same parameters.

According to actual requirements, 2Cr13 is used as material for manufacturing the refining segment and the designed curved bar plate shown in FIG. 6 was machined. It is compared with a refiner plate with straight bars (as shown in FIG. 7 and the detailed parameters can be found in Table 1), with same parameters such as the bar angle, the bar width, the bar height and the groove width, by low consistency refining tests in which bleached sulfate *eucalyptus* pulp is used as the pulp for experiments and its consistency is controlled at 3%. Cyclic refining tests were carried out by a MD3000 single-plate refiner at a constant rotation speed (1460 rpm). It was found that the refiner plate with curved bars designed in the present invention has a refining intensity lower than that of the refiner plate with straight bars. The length of fibers is effectively maintained while keeping a same freeness. The average length of fibers is 20%-30% greater than that of pulp obtained by using the refiner plate with straight bars, as shown in FIGS. 8 and 9.

TABLE 1

| | Straight bar | | | | Curved bar | | | |
|---|---|---|---|---|---|---|---|---|
| | BEL | | | | | | | |
| | 276.55 m/rev | | | | 327.58 m/rev | | | |
| | A | | | | | | | |
| | (20°, 55 mm) | | | | (20°, 43 mm) | | | |
| | Bar width | Channel width | Bar height | α | Inner radius | Outer radius | Center angle of segment | Number of bars |
| Common bar parameters | 2 mm | 3 mm | 4 mm | 42° | 82.5 mm | 203 mm | 40° | 117 |

What is claimed is:

1. A method for designing a refiner plate with equidistant curved bars, comprising the following steps:

step 1)

defining, on the basis of defining a bar angle of the curved bars, a center circle arc for the curved bars, and establishing an equation for the circle arc for the curved bars by establishing a polar coordinate system; wherein the step 1) comprises the following steps:

substep 1 ): setting an inner diameter of the refining segment as $R_i$ ; setting an outer diameter of the refining segment as $R_o$; setting a circle center of the refining segment as O; setting a center circle arc of the refining segment as MN; setting a radius of the center circle arc MN as $(R_i+R_o)/2$; defining a bisector of the refining segment as OB; and intersecting the center circle arc in the refining segment with OB at a point B, making BD passing through the point B at the top right of OB if the curved bars are right-hand bars and making BD passing through the point B at the top left of OB if the curved bars are left-hand bars;

representing an included angle between BD and OB by α, selecting any point A from an inner circle in the refining segment as a starting point of the curve bars, connecting the points O and A, making a circle $O_1$ passing through the points A and B by using BD as a tangent line, making a tangent line AE, passing through the point A, which is tangent to the circle $O_1$ with an included angle between AE and OA represented by β, with a line perpendicular to the tangent line AE and a line perpendicular to BD intersecting at a point $O_1$ and the radius of the circle $O_1$ being measured as $R_1$; and obtaining an intersected portion of the circle $O_1$ with inner and outer circles in the refining segment as a center line for curved bars, and assuming that an included angle a between the tangent line BD that is tangent to the center line for curved bars at the point B and OB starting from the point B in the radius direction is the angle of inclination of the equidistant curved bars and an included angle βbetween the tangent line AE that is tangent to the circle $O_1$ at the point A and OA is a starting angle of inclination of the equidistant curved bars;

substep 2): designing a center circle arc AC for the equidistant curved bars by determining the points A and B and defining a bar angle a, wherein A is the starting point of the center arc for the bars, which can be expressed by (γ, $r_A$), where γ is an included angle between the OA and the center line of the refining segment, $r_A$ is the radius of the circle where the starting point is located, and then the center arc AC for the equidistant curved bars can be determined by the point A and the bar angle α; and obtaining an equation for the circle $O_1$ according to the polar coordinate system by:

using the point $O_1$ as a pole and drawing a horizontal ray O-x from the pole as a polar axis, using the clockwise direction as the positive direction, and representing an included angle between a connecting line from any one point on the circle $O_1$ to the pole, and the polar axis as θ:

$$\begin{cases} x = R_1\cos\theta \\ y = R_1 \times \sin\theta \end{cases} \tag{1}$$

wherein the equation (1) is the equation for the circle of the center circle arc AC for the equidistant curved bars;

substep 3): setting the width of the curved bars as b, and respectively representing equations for inner and outer circle arcs for the center bars as:

$$\begin{cases} x = \left(R_1 + \frac{b}{2}\right)\cos\theta \\ y = \left(R_1 + \frac{b}{2}\right)\sin\theta \end{cases} \text{ and } \begin{cases} x = \left(R_1 - \frac{b}{2}\right)\cos\theta \\ y = \left(R_1 - \frac{b}{2}\right)\sin\theta \end{cases}; \tag{2}$$

step 2)

establishing, in consideration of a bar width and a groove width, an equation for circle arcs for bars on two sides of the center circle arc;

step 3) when the whole a refining segment is full of circle arcs of bars, trimming lines of outer circle arcs of the refining segment to complete the design of equidistant circle arcs on the two sides, wherein, according to refining process requirements, the refiner plate with equidistant curved bars is divided into zones along a predetermined standard line and then the curved bars are trimmed, a bar height is determined according to the specific process requirements; and step 4) machining such a refiner plate in accordance with methods for common refiner plates by casting which is applicable for industrial mass-production of refiner plates and milling which is applicable for experimental refiner plates, with casting including the following operations as main steps: design and development of a refining segment mold, manufacture of a cavity suitable for casting, alloy smelting and casting, opening the mold for the purpose of cleaning, initial machining, thermal treatment, finish machining, and inspection.

2. The method for designing the refiner plate with equidistant curved bars according to claim 1, wherein the step 2) comprises the following steps:

substep 1: setting the groove width of curved bar plate as g, when the refining segment with equidistant curved bars are designed with right-hand curved bars, representing an equation for a circle arc for the first bar on the left side of the circle arc for the center bar as:

$$\begin{cases} x = \left(R_1 + \frac{b}{2} + g\right)\cos\theta \\ y = \left(R_1 + \frac{b}{2} + g\right)\sin\theta \end{cases} \tag{3}$$

representing an equation for a circle arc for a $2n^{th}$ bar on the left side as:

$$\begin{cases} x = \left(R_1 + \frac{b}{2} + n(g+b)\right)\cos\theta \\ y = \left(R_1 + \frac{b}{2} + n(g+b)\right)\sin\theta \end{cases} \tag{4}$$

representing an equation for a circle arc for a $(2n+1)^{th}$ bar on the left side as:

$$\begin{cases} x = \left(R_1 + \frac{b}{2} + g + n(g+b)\right)\cos\theta \\ y = \left(R_1 + \frac{b}{2} + g + n(g+b)\right)\sin\theta \end{cases} \tag{5}$$

where, n≥1;

when the refining segment with equidistant curved bars are designed with left-hand curved bars, equations for circle arcs for bars on the right side of the circle arc for the center bar are the same as equations for circle arcs for bars on the left side of the circle arc for the center bar in the case where the refining segment is designed with right-hand curved bars;

substep 2:

when the refining segment with equidistant curved bars are designed with right-hand curved bars, representing an equation for a circle arc for the first bar on the right side of the circle arc for the center bar as:

$$\begin{cases} x = \left(R_1 - \frac{b}{2} - g\right)\cos\theta \\ y = \left(R_1 - \frac{b}{2} - g\right)\sin\theta \end{cases} \tag{6}$$

representing an equation for a circle arc for a $2n^{th}$ bar on the right side as:

$$\begin{cases} x = \left(R_1 - \frac{b}{2} - n(g+b)\right)\cos\theta \\ y = \left(R_1 - \frac{b}{2} - n(g+b)\right)\sin\theta \end{cases} \tag{7}$$

representing an equation for a circle arc for a $(2n+1)^{th}$ bar on the right side as:

$$\begin{cases} x = \left(R_1 - \frac{b}{2} - g - n(g+b)\right)\cos\theta \\ y = \left(R_1 - \frac{b}{2} - g - n(g+b)\right)\sin\theta \end{cases} \tag{8}$$

where, n≥1 and n is a positive integer;

when the refining segment with equidistant curved bars are designed with left-hand curved bars, equations for circle arcs for bars on the left side of the circle arc for the center bar are the same as equations for circle arcs for bars on the right side of the circle arc for the center bar in the case where the refining segment is designed with right-hand curved bars.

3. The method for designing the refiner plate with equidistant curved bars according to claim 1, wherein the step 3) comprises the following steps:

after the design of the refiner plate with equidistant curved bars and the design of the circle arcs are completed, if required, dividing the refiner plate into zones by concentric circle arcs, circle arcs or broken lines;

wherein, during the division by concentric circle arcs, the refiner plate is divided into three stages: a breaking zone, a coarse refining zone and a fine refining zone, at a ratio of $k_1:k_2:k_3$, and equations for circle arcs in the crushing zone and the coarse refining zone are represented as:

$$\begin{cases} x = \left[\frac{k_1(R_0 - R_i)}{k_1 + k_2 + k_3} + R_i\right]\cos\theta \\ y = \left[\frac{k_1(R_0 - R_i)}{k_1 + k_2 + k_3} + R_i\right]\sin\theta \end{cases} \quad (9)$$

equations for circle arcs in the coarse refining zone and the fine refining zone are represented as:

$$\begin{cases} x = \left[\frac{(k_1 + k_2)(R_0 - R_i)}{k_1 + k_2 + k_3} + R_i\right]\cos\theta \\ y = \left[\frac{(k_1 + k_2)(R_0 - R_i)}{k_1 + k_2 + k_3} + R_i\right]\sin\theta \end{cases} \quad (10)$$

the methods for determining equations for concentric circle arcs in other zones are similar to equations (9) and (10);

after the division, according to process requirements, the bars are optimized, and usually, the number of bars in the breaking zone, the coarse refining zone and the fine refining zone are successively increased.

* * * * *